US006581024B1

(12) United States Patent
Shimizu

(10) Patent No.: US 6,581,024 B1
(45) Date of Patent: Jun. 17, 2003

(54) CONSUMER TRANSACTION FACILITY

(75) Inventor: Köji Shimizu, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/413,894

(22) Filed: Oct. 7, 1999

(30) Foreign Application Priority Data

May 13, 1999 (JP) ..... 11-132418

(51) Int. Cl.[7] ..... G08B 7/00

(52) U.S. Cl. ..... 702/176; 702/139; 702/150; 702/152; 702/183; 702/187; 702/188

(58) Field of Search ..... 702/121, 139, 702/150, 152, 176–178, 183, 187, 188, FOR 103, FOR 104, FOR 134, FOR 141, FOR 143, FOR 154, FOR 170, FOR 171; 340/5.9, 5.91, 5.4, 5.41, 5.42, 5.19, 287, 332; 705/1, 7, 10, 16, 500; 377/13, 16; 235/379, 377, 380; 902/8

(56) References Cited

U.S. PATENT DOCUMENTS

| | | | | | |
|---|---|---|---|---|---|
| 3,845,277 | A | * | 10/1974 | Voss et al. | 235/61.7 B |
| 4,398,257 | A | * | 8/1983 | Paganini et al. | 364/550 |
| 4,700,295 | A | * | 10/1987 | Katsof et al. | 364/401 |
| 4,754,126 | A | * | 6/1988 | Caldwell | 235/379 |
| 5,245,163 | A | * | 9/1993 | Yehuda | 235/377 |
| 5,340,967 | A | * | 8/1994 | Martin et al. | 235/379 |
| 5,408,210 | A | * | 4/1995 | Oka | 340/286.06 |
| 5,473,143 | A | * | 12/1995 | Vak et al. | 235/380 |
| 5,508,500 | A | * | 4/1996 | Martin et al. | 235/381 |
| 5,541,835 | A | * | 7/1996 | Dextraze et al. | 364/401 R |
| 5,915,246 | A | * | 6/1999 | Patterson et al. | 705/43 |
| 5,917,168 | A | * | 6/1999 | Nakamura et al. | 235/379 |
| 5,949,045 | A | * | 9/1999 | Ezawa et al. | 235/379 |
| 6,039,245 | A | * | 3/2000 | Symonds et al. | 235/379 |
| 6,199,754 | B1 | * | 3/2001 | Epstein | 235/379 |
| 6,223,983 | B1 | * | 5/2001 | Kjonaas et al. | 235/379 |
| 6,230,928 | B1 | * | 5/2001 | Hanna et al. | 221/13 |
| 6,278,978 | B1 | * | 8/2001 | Andre et al. | 705/9 |

FOREIGN PATENT DOCUMENTS

| | | | |
|---|---|---|---|
| JP | 55-13461 | | 1/1980 |
| JP | 03033995 | * | 2/1991 |
| JP | 3-63872 | | 3/1991 |
| JP | 4-316193 | | 11/1992 |
| JP | 8-249398 | | 9/1996 |
| JP | 8249398 | * | 9/1996 |

* cited by examiner

*Primary Examiner*—Marc S. Hoff
*Assistant Examiner*—Carol S. Tsai
(74) *Attorney, Agent, or Firm*—Staas & Halsey LLP

(57) ABSTRACT

There is disclosed a consumer transaction facility for performing consumer transactions with customers, such as for example, an automatic teller machine (ATM) and a cash dispenser (CD). In order to consider a customer who is obliged to wait one's turn, a time during a period of time from a time wherein a customer removes the front to a time wherein a successive customer stands the front is measured, and in the event that the measure time is short, a specific message is outputted.

9 Claims, 5 Drawing Sheets

CONSUMER TRANSACTION FACILITY

BACKGROUND OF THE INVENTION

1. Field of the Invention

The present invention relates to a consumer transaction facility for performing consumer transactions with customers, such as for example, an automatic teller machine (ATM) and a cash dispenser (CD).

2. Description of the Prior Art

Today, a consumer transaction facility is installed in a bank and the like, and it is general to perform consumer transactions such as a receipt of money and a transfer of money. Such a consumer transaction facility serves to compensate for a shortage of workers, and it is convenient for customers.

However, in some time, for example, in a utilizing time zone for a consumer transaction facility, it happens that the consumer transaction facility is thronged with users, and thus it is obliged for customers to wait for a while. Even in this situation, according to the conventional consumer transaction facility, there is taken no measures to meet the situation, and there is simply received the users in turn without taking into account a situation that the users are obliged to wait.

SUMMARY OF THE INVENTION

In view of the foregoing, it is an object of the present invention to provide a consumer transaction facility taking into account a situation that the users are obliged to wait.

To achieve the above-mentioned objects, the present invention provides a consumer transaction facility for performing transactions in accordance with an operation of a customer, said consumer transaction facility comprising:

a customer sensor for detecting whether a customer stands in front of said consumer transaction facility;

an interface unit for notifying a customer of a message;

a timer unit for measuring a time of a customer's absence during a period of time from a first timing wherein it is detected by said customer sensor that a customer removes from the front to a second timing wherein another customer stands in front of said consumer transaction facility; and a determining unit for determining whether the time of a customer's absence measured by said timer unit is within a predetermined time, wherein in a case where said determining unit determines that the time of a customer's absence is within the predetermined time, said interface unit notifies a customer of a message associated with a matter that the time of a customer's absence is within the predetermined time.

In the above-mentioned consumer transaction facility according to the present invention, it is acceptable that said interface unit notifies a customer of mutually different messages in accordance with a decision result by said determining unit.

In the above-mentioned consumer transaction facility according to the present invention, it is acceptable that said interface unit notifies a customer of a message by a screen display. Alternatively, it is acceptable that said interface unit notifies a customer of a message by a voice.

In the above-mentioned consumer transaction facility according to the present invention, typically, said customer sensor is provided on a main frame of said consumer transaction facility.

In the above-mentioned consumer transaction facility according to the present invention, it is acceptable that said timer unit starts clocking in the first timing and stops clocking in the second timing. In the above-mentioned consumer transaction facility according to the present invention, it is acceptable that said timer unit stores a time of the first timing in the first timing, and determines in the second timing a difference between a time of the second timing and the time of the first timing which is stored.

The consumer transaction facility according to the present invention is typically to perform a transfer of cash with a customer.

When a time interval (a time of a customer's absence) from a timing wherein a customer removes from the front to a timing wherein a successive customer stands the front is short, it is considered that the later customer waited one's turn. Thus, according to the consumer transaction facility according to the present invention, a message associated with the matter of waiting, for example, a message for an apology for waiting, is conveyed to the customer. This makes it possible even somewhat to ease dissatisfaction of a customer who was obliged to wait one's turn.

DETAILED DESCRIPTION OF PREFERRED EMBODIMENTS

Hereinafter, there will be described embodiments of the present invention.

Figure 1:
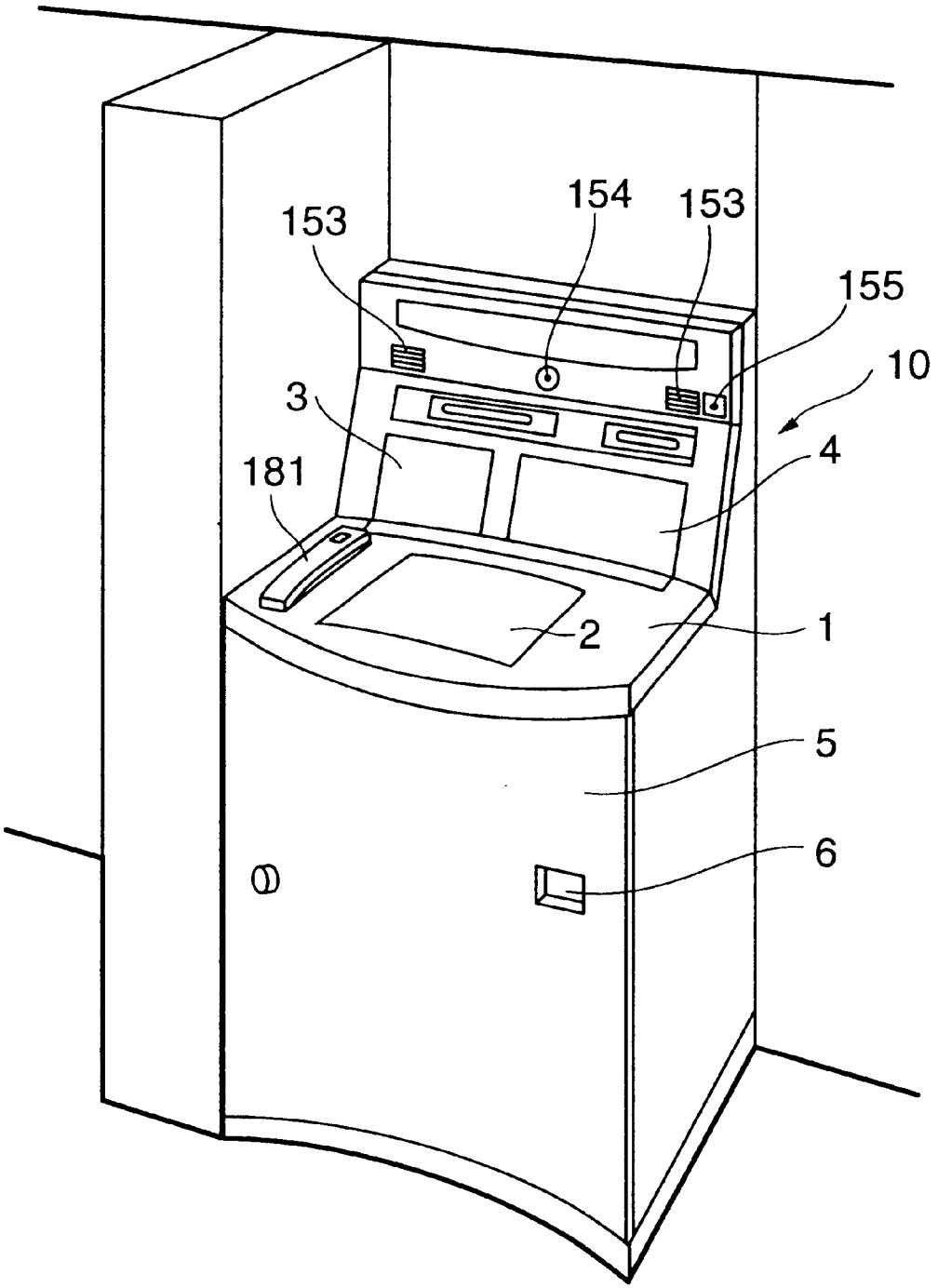
FIG. 1 is a perspective view of an ATM which is an embodiment of a consumer transaction facility according to the present invention.

FIG. 1 is a perspective view of an ATM which is an embodiment of a consumer transaction facility according to the present invention.

On the top of a console panel 1 of an ATM 10, there is provided a console display unit 2 comprising a color display and a transparent touch keyboard superposed on the color display. A customer stands in front of the ATM 10 and touches with one's finger the console display unit 2 in accordance with display contents displayed on the console display unit 2 and contents of transactions intended by oneself, so that the intended transactions are performed in accordance with an operation by touching the console display unit 2.

There is provided a touch button type of receiver 181 at the position adjacent to the console display unit 2 on the console panel 1. The receiver 181 is for providing a message to an amblyopic person through a voice so that the amblyopic person performs an operation through touch buttons.

At the depths of the console panel 1 there are provided a coin insertion slot 3 for opening and closing for insertion of coins and a bill insertion slot 4 for opening and closing for insertion of bills. At a front door 5 in the lower part of the console panel 1, which are usually locked, there is provided a coin return slot 6 for returning coins.

Further, on the top part of the coin insertion slot 3 and the bill insertion slot 4, there is provided a pair of speakers 153 and 153 for notifying a customer of a message through a voice. At a position adjacent to one of the speakers 153 and 153 there is provided a call button 155 for calling a clerk in charge when a trouble occurs. At the center of the speakers 153 and 153 there is provided a customer sensor 154 for detecting whether a customer stands in front of the ATM 10.

Figure 2:
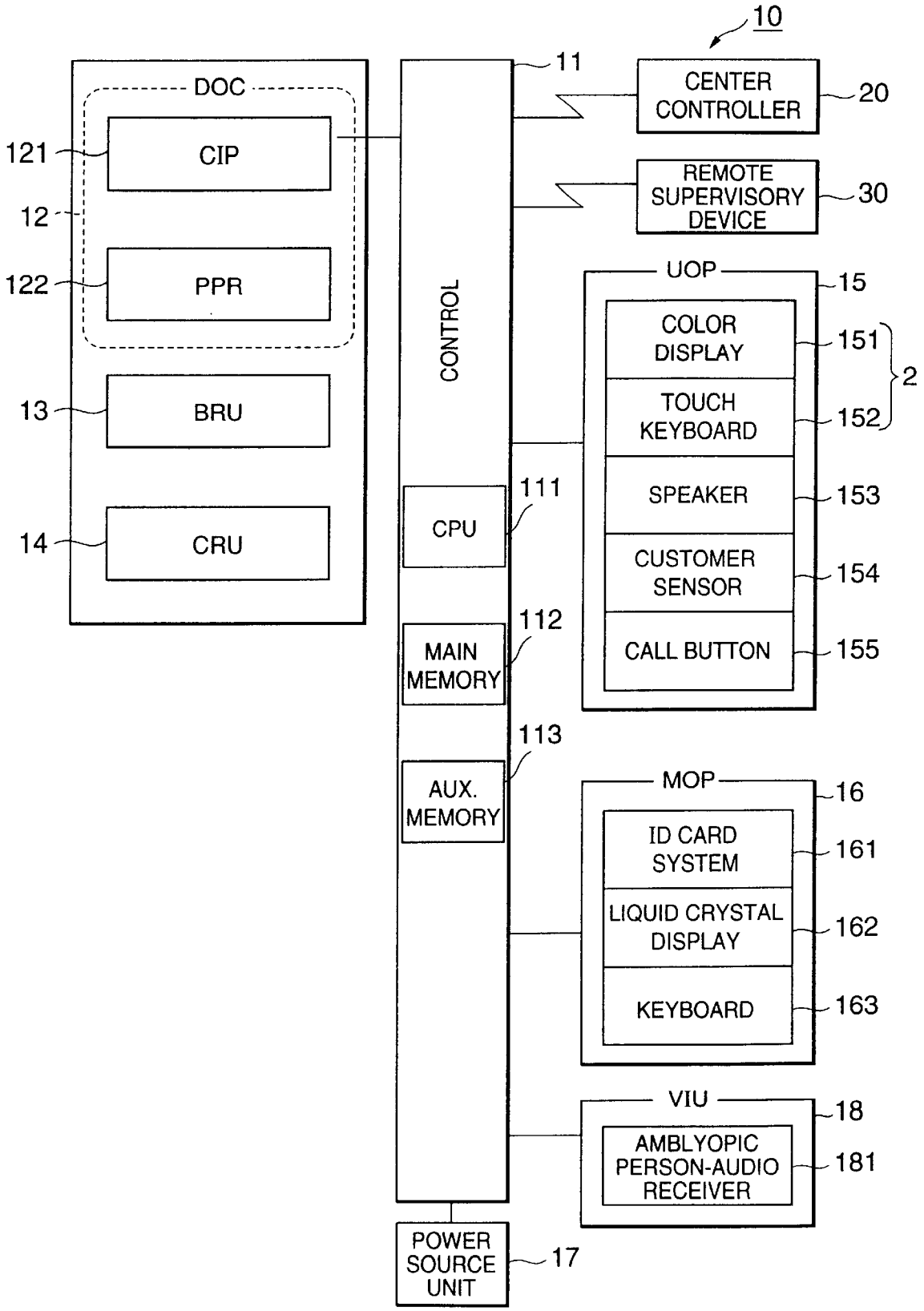
FIG. 2 is a block diagram of an internal structure of the ATM shown in FIG. 1.

FIG. 2 is a block diagram of an internal structure of the ATM shown in FIG. 1.

The ATM 10 shown in FIG. 2 comprises a control unit 11, a DOC (Document Output and Card reader writer) 12, a BRU (Bill Recycle Unit) 13, a CRU (Coin Recycle Unit) 14, UOP (User Operating Unit) 15, an MOP (Management Operating Unit) 16, a power source 17, and a VIU (amblyopic person-audio receiver) 18.

The control unit 11 controls the ATM 10 in its entirety, and comprises a CPU 111 for executing a program, a main memory for storing the program to be executed in the CPU 111, and an auxiliary storage unit 113 having a magnetic disc drive unit for driving a magnetic disc and a floppy disc drive for driving a floppy disc.

The control unit 11 controls, upon receipt of operating information of customers, a transfer of cash between the customers, and manages cash stored and the like. Further, the control unit 11 receives an instruction of a center controller 20 and informs the center controller 20 of a state of the ATM 10. The control unit 11 is connected to a remote supervisory device 30 which monitors a customer operating the ATM 10 and the ATM 10 per se in accordance with information obtained from a customer sensor 154 provided on the UOP 15.

The DOC 12 deals with a cash card and a passbook and comprises a CIP (Card reader/writer Image reader Printer) 121 having functions of reading contents recorded on a magnetic stripe of a cash card and recording transaction contents on a receipt, and a PPR (Passbook Printer) 122 having a function of recording for a passbook.

The BRU 13 deals with money receipt and payment for bills with a user (customer) of the ATM 10. When bills are entered to the ATM 10 by the user of ATM 10, the BRU 13 classifies the bills for each sort of bill to store those bills. When bills are paid from the ATM 10 to a user, the BRU 13 performs a payment using bills which are classified and stored beforehand.

The CRU 14 deals with money receipt and payment for coins with a user (customer) of the ATM 10.

The UOP 15 is a user operating unit in which a user (customer) of the ATM 10 performs an operation for money receipt and payment. The UOP 15 comprises a color display 151 for displaying information for customers, a touch keyboard 152 for inputting a customer's PIN and sums, the speaker 153 for performing an audio guidance necessary for customers, the customer sensor 154 for detecting whether a customer stands in front of the ATM 10 so that detected information is reflected on operations of the color display 151 the speaker 153, and a call button 155 for calling a clerk in charge when a trouble occurs.

The MOP 16 is operated by a member of the staff and the like of a financial institution in which the ATM 10 is set up. The MOP 16 comprises an ID card system 161 for controlling an electromagnetic lock referring to an IC card for confirming that he is a person who is authorized in operation of the MOP 16, a liquid crystal display 162 for displaying information for the operation, and a keyboard 163 for operation.

A power source 17 supplies electric power necessary for the ATM 10.

The VIU 18 comprises a receiver 181 in which push-phone type of buttons are arranged. It is possible for a amblyopic person to enter one's PIN and sums through operation of the push-phone type of buttons in accordance with an audio guidance by the receiver 181, but not an operation of the touch keyboard 152.

Figure 3:
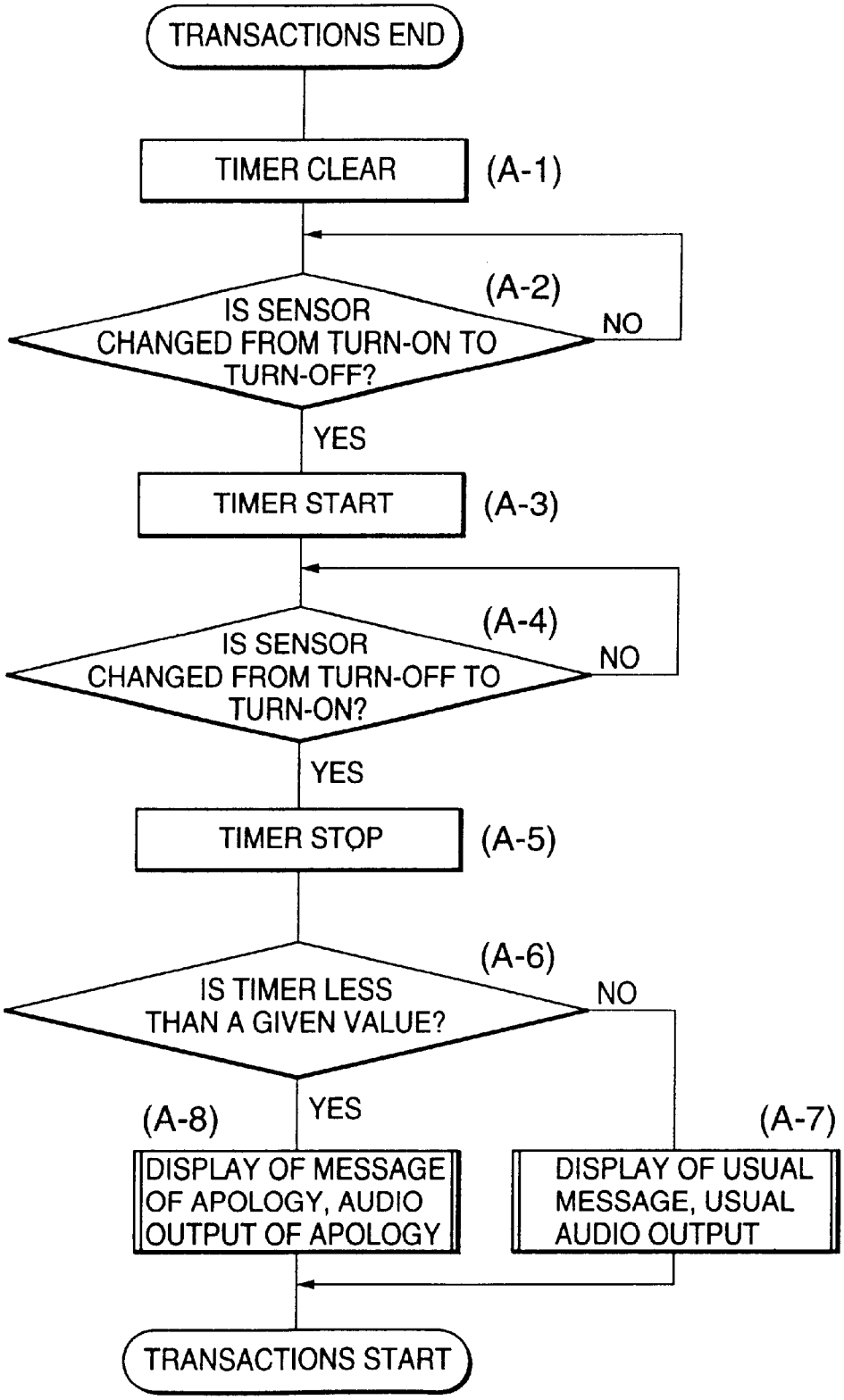
FIG. 3 is a flowchart of a program concerned with characteristic portions of the present invention, of programs executed in a CPU of a control unit shown in FIG. 2.

FIG. 3 is a flowchart of a program concerned with characteristic portions of the present invention, of programs executed in the CPU 111 of the control unit 11 shown in FIG. 2.

When a transaction with a customer, who stands in front of the ATM 10, is terminated, a routine shown in FIG. 3 starts. When this routine starts, first, a timer is reset (step A-1) so that it is monitored that the customer sensor 154 changes from a state of turn-on (a state that a customer stands in front of the ATM) to a state of turn-off (a state that the customer removes from the front of the ATM) (step A-2).

When the customer sensor 154 changes from the state of turn-on to the state of turn-off, the timer starts to clock (step A-3).

After the start of clocking, it is monitored that the customer sensor 154 changes again to the state of turn-on (step A-4). When the customer sensor 154 changes from the state of turn-off to the state of turn-on, the timer stops in clocking (step A-5). And it is determined that a clocking value of the timer is less than a given value (step A-6).

When the clocking value of the timer exceeds the given value, the process goes to a step A-7 in which the color display 151 constituting the console display unit 2 displays the usual message corresponding to the matter that a customer stands in front of the ATM 10, and in addition the usual voice is outputted from the speaker 153.

On the other hand, when the clocking value of the timer is less than the given value, it may be interpreted that a new customer waited while the previous customer operated. Thus, the process goes to a step A-8 in which the color display 151 displays a message of the apology for waiting and in addition the speaker 153 outputs a voice of the apology for waiting.

Figure 4:
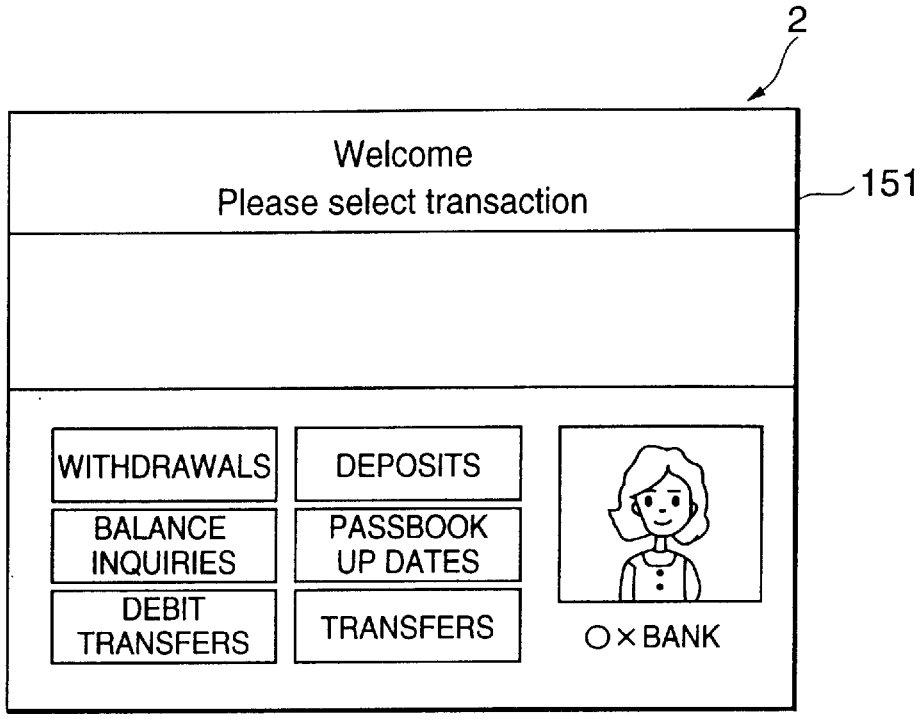
FIG. 4 is an illustration showing an example of a usual display screen displayed on a color display.
Figure 5:
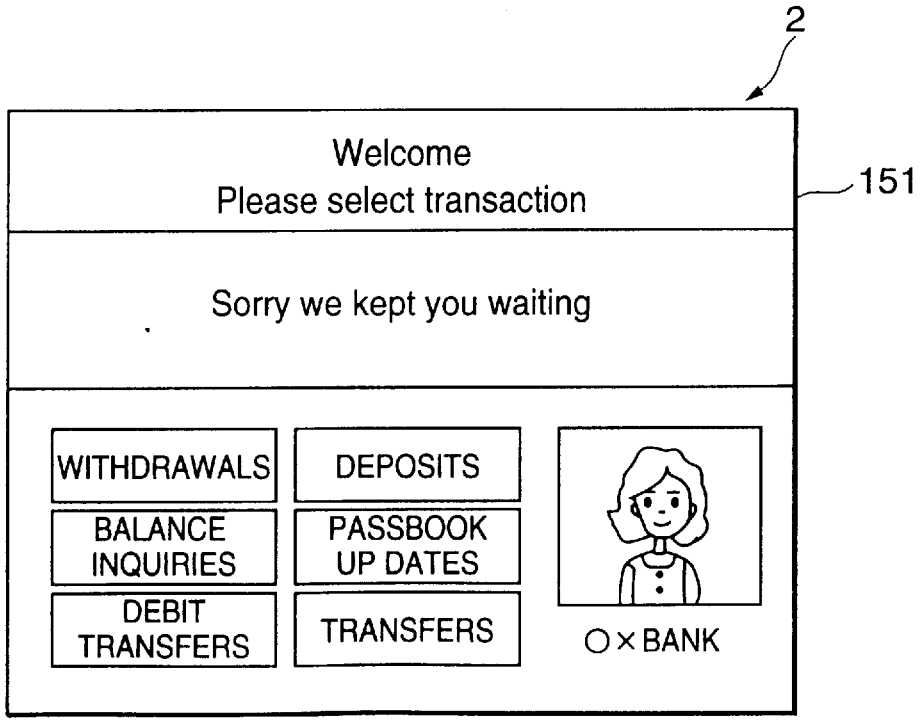
FIG. 5 is an illustration showing an example of a display screen including a message of an apology.

FIG. 4 is an illustration showing an example of a usual display screen displayed on a color display. FIG. 5 is an illustration showing an example of a display screen including a message of an apology.

When the process goes to the step A-7, the color display 151 displays the usual message shown in FIG. 4, and in addition the speaker 153 outputs a voice of "Welcome". On the other hand, when the process goes to the step A-8, the color display 151 displays the message shown in FIG. 4 and in addition a message of the apology for waiting, such as "Sorry we kept you waiting", and the speaker 153 outputs a voice of "Sorry we kept you waiting".

In cases of FIGS. 4 and 5, they are the same as one another in function except for presence of the message of "Sorry we kept you waiting". In both the cases of FIGS. 4 and 5, there are displayed icons of "withdrawals", "deposits", "balance inquiries", "passbook updates", "debit transfers", and "transfers". As the console display unit 2 is touched in such a manner that one of those icons is depressed, a processing associated with the touched icon is executed.

Figure 6:
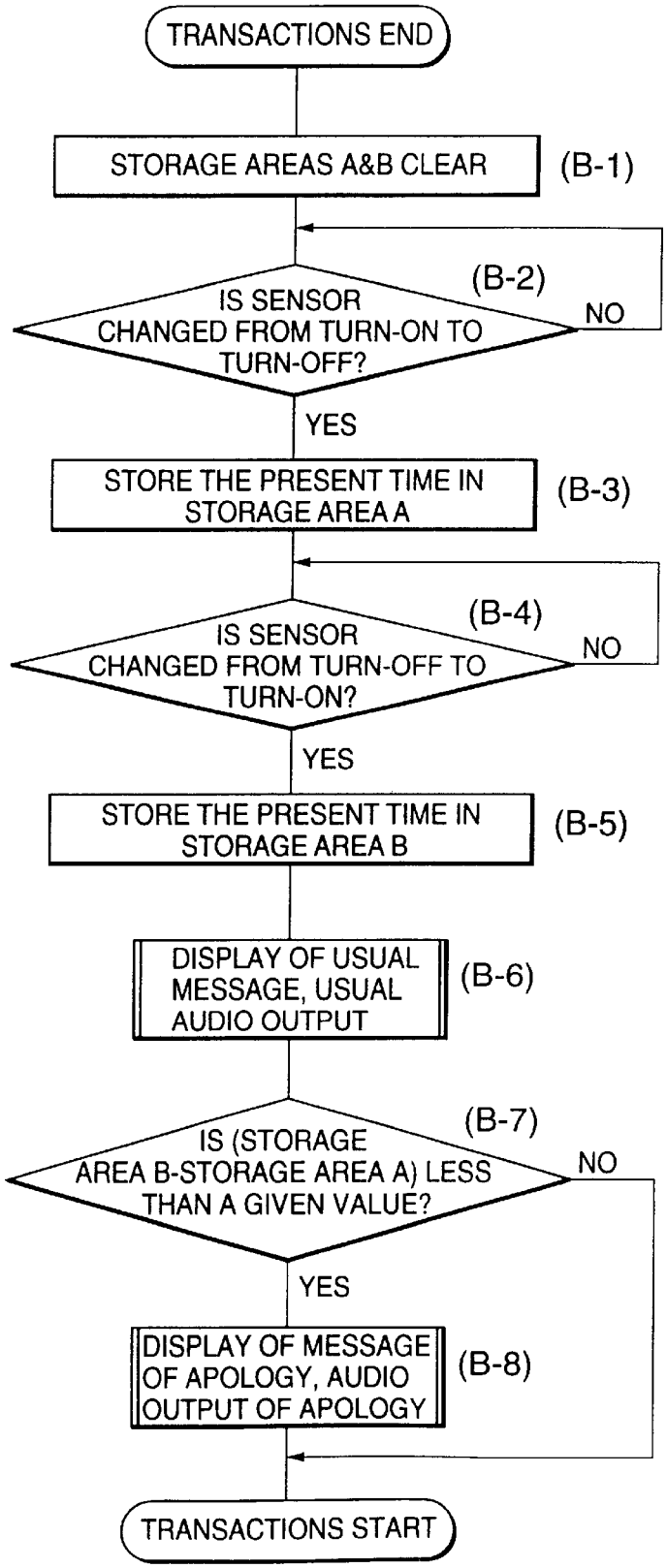
FIG. 6 is an alternative flowchart of a program concerned with characteristic portions of the present invention, as the alternative to the program shown in FIG. 3.

FIG. 6 is an alternative flowchart of a program concerned with characteristic portions of the present invention, as the alternative to the program shown in FIG. 3.

When the transaction with a customer, who stands in front of the ATM shown in FIG. 1, is terminated, the routine shown in FIG. 6 starts. In step B-1, two storage areas A and B of the main memory 112 shown in FIG. 2 are cleared. In step B-2, it is monitored that the customer sensor 154 is changed from the turn on to the turn off. When the customer sensor 154 is changed from the turn on to the turn off, the current time is stored in the storage area A in the changed timing (step B-3). In step B-4, it is waited until the customer sensor 154 is changed from the turn off to the turn on, in other words, until a new customer stands in front of the ATM 10. When the customer sensor 154 is changed from the turn off to the turn on, the current time is stored in the storage area B in the changed timing (step B-5), and the usual screen shown in FIG. 4 is displayed on the color display 151 and in addition a voice of "Welcome" is outputted from the speaker 153 (step B-6).

Next, a difference between the time stored in the storage area B and the time stored in the storage area A is calculated, and it is determined whether the difference thus obtained is less than a given value (step B-7). When the difference exceeds the given value, this routine is terminated. When the difference does not exceed the given value, the color display 151 displays the message shown in FIG. 4 and in addition a message of the apology for waiting, such as "Sorry we kept you waiting", and the speaker 153 outputs a voice of "Sorry we kept you waiting" (step B-8).

As shown in the flowchart of FIG. 6, in the event that a time from a timing wherein the customer sensor 154 changes from the turn-on to the turn-off to a timing wherein the customer sensor 154 changes from the turn-off to the turn-on is short, it is acceptable that a message associated with the shortage of the time is outputted. Alternatively, as shown in the flowchart of FIG. 3, it is acceptable that a different message is outputted in accordance with a length of the time.

When the length of the time is measured, it is acceptable that as shown in the flowchart of FIG. 3, a clocking starts in a timing wherein the customer sensor 154 changes from the turn-on to the turn-off, and stops in a timing wherein the customer sensor 154 changes from the turn-off to the turn-on. Alternatively, it is acceptable that as shown in the flowchart of FIG. 6, a difference between a time as to a timing wherein the customer sensor 154 changes from the turn-on to the turn-off and a time as to a timing wherein the customer sensor 154 changes from the turn-off to the turn-on is calculated.

According to the present embodiment, in the event that the measured time is short, both the display and the voice of the message, such as "sorry we kept you waiting", are outputted. However, it is acceptable that only one of the display and the voice is outputted. It is noted that the message to be outputted is not restricted to "sorry we kept you waiting", and it is acceptable that an alternative expression is used. Further, it is noted that the message is notified through motion of dolls shown in FIGS. 4 and 5 for example.

As mentioned above, according to a consumer transaction facility of the present invention, it is possible to ease dissatisfaction of a customer who was obliged to wait one's turn.

While the present invention has been described with reference to the particular illustrative embodiments, it is not to be restricted by those embodiments but only by the appended claims. It is to be appreciated that those skilled in the art can change or modify the embodiments without departing from the scope and sprit of the present invention.

What is claimed is:

1. A consumer transaction facility for performing transactions in accordance with an operation of a customer, said consumer transaction facility comprising:

a customer sensor for detecting whether a customer stands in front of said consumer transaction facility;

a timer unit measuring a time of a customer's absence during a period of time from a first timing wherein it is detected by said customer sensor that a customer removes from the front to a second timing wherein another customer stands in front of said consumer transaction facility;

a determining unit determining whether the time of a customer's absence measured by said timer unit is within a predetermined time; and an interface unit notifying a customer of a message, wherein the message is a greeting if the time of a customer's absence is outside of the predetermined time, and wherein the message is an apology if the time of a customer's absence is within the predetermined time.

2. A consumer transaction facility according to claim 1, wherein said interface unit notifies a customer of a message by a screen display.

3. A consumer transaction facility according to claim 1, wherein said interface unit notifies a customer of a message by a voice.

4. A consumer transaction facility according to claim 1, wherein said customer sensor is provided on a main frame of said consumer transaction facility.

5. A consumer transaction facility according to claim 1, wherein said timer unit starts clocking in the first timing and stops clocking in the second timing.

6. A consumer transaction facility according to claim 1, wherein said timer unit stores a time of the first timing in the first timing, and determines in the second timing a difference between a time of the second timing and the time of the first timing which is stored.

7. A consumer transaction facility according to claim 1, wherein said consumer transaction facility performs a transfer of cash with a customer.

8. A consumer transaction facility for performing transactions in accordance with an operation of a customer, the consumer transaction facility comprising:

only one customer sensor to detect whether a customer stands in front of the consumer transaction facility;

an interface unit to notify a customer of a message;

a timer unit to measure a time of a customer's absence during a period of time from a first timing wherein it is detected by the customer sensor that a customer removes from the front to a second timing wherein another customer stands in front of the consumer transaction facility; and a determining unit to determine whether the time of a customer's absence as measured by the timer unit is within a predetermined time, wherein in a case where the determining unit determines that the time of a customer's absence is within the predetermined time, the interface unit notifies a customer of a message associated with a matter that the time of a customer's absence is within the predetermined time.

9. A consumer transaction facility for performing transactions in accordance with an operation of a customer, the consumer transaction facility comprising:

only one customer sensor to detect whether a customer stands in front of the consumer transaction facility;

a timer unit to measure a time of a customer's absence during a period of time from a first timing wherein it is detected by the customer sensor that a customer removes from the front to a second timing wherein another customer stands in front of the consumer transaction facility;

a determining unit to determine whether the time of a customer's absence measured by the timer unit is within a predetermined time; and an interface unit to notify a customer of a message, wherein the message is a greeting if the time of a customer's absence is outside of the predetermined time, and wherein the message is an apology if the time of a customer's absence is within the predetermined time.

* * * * *

UNITED STATES PATENT AND TRADEMARK OFFICE

CERTIFICATE OF CORRECTION

PATENT NO. : 6,581,024 B1
DATED : June 17, 2003
INVENTOR(S) : Köji Shimizu

It is certified that error appears in the above-identified patent and that said Letters Patent is hereby corrected as shown below:

Title page,
Item [75], Inventor, change "Köji Shimizu" to -- Kōji Shimizu --.

Signed and Sealed this

Ninth Day of December, 2003

JAMES E. ROGAN
*Director of the United States Patent and Trademark Office*